US005476247A

United States Patent [19]

Melder

[11] Patent Number: 5,476,247

[45] Date of Patent: Dec. 19, 1995

[54] LOAD BLOCK

[75] Inventor: Charles L. Melder, Katy, Tex.

[73] Assignee: MSI Crane & Equipment Co., Katy, Tex.

[21] Appl. No.: 138,953

[22] Filed: Oct. 18, 1993

[51] Int. Cl.[6] ..... B66D 3/06; B66C 1/34

[52] U.S. Cl. ..... 254/404; 254/401; 254/403; 294/82.1

[58] Field of Search ..... 254/390, 394, 254/401–404, 409, 411, 412, 281, 284, 326, 335; 294/82.1, 82.15, 82.16, 82.11

[56] References Cited

U.S. PATENT DOCUMENTS

| | | | |
|---|---|---|---|
| 1,713,586 | 5/1929 | Wright | 254/404 |
| 2,292,457 | 8/1942 | Maier | 254/394 |
| 2,536,417 | 1/1951 | Black | 254/401 |
| 2,570,320 | 10/1951 | Christensen | 254/401 |
| 2,657,905 | 11/1953 | Bennett | 254/404 |
| 2,681,794 | 6/1954 | Johnson | 254/401 |
| 2,717,184 | 9/1955 | Amerman | 254/404 X |
| 2,980,400 | 4/1961 | Long | 254/401 |
| 3,179,376 | 4/1965 | Botten | 254/401 |
| 4,466,651 | 8/1984 | Sowa et al. | 294/82.16 |

*Primary Examiner*—Daniel P. Stodola
*Assistant Examiner*—Michael R. Mansen
*Attorney, Agent, or Firm*—Harrison & Egbert

[57] ABSTRACT

A load block having a body, a sheave rotatably positioned within the body, and a hook having a shank received within the body and having a portion positioned in a generally air-tight volume within the body. The body includes a first side plate, a second side plate in generally parallel relationship to the first side plate, and a crossblock affixed to and extending between the first and second side plates. The air-tight volume is formed within the crossblock. The crossblock includes a cover which is affixed to a top surface of the crossblock and is in generally liquid-tight relationship to the crossblock. A liquid fills the volume of the crossblock so as to extend around a portion of the shank. The cover has a check valve positioned on a surface for allowing air to pass from the volume and for preventing air from passing into the volume. The sheave includes an inner race around a bearing assembly adjacent to a shaft formed in the body. A pair of dead-eyes are positioned on opposite sides of the body.

13 Claims, 4 Drawing Sheets

LOAD BLOCK

TECHNICAL FIELD

The present invention relates to lifting devices and cranes, generally. More particularly, the present invention relates to load blocks which are associated with cranes for the purpose of lifting objects.

BACKGROUND ART

Cranes are often used in the marine environment for the purposes of lifting objects or for the purposes of placing objects from one position to another. The cranes are often used in offshore operations, such as drilling rigs, ships, and loading facilities. In nearly all applications, cranes typically includes a boom which extends outwardly from a platform, a lifting line extending along the boom, and a load block which is received at the end of the line. A hook is positioned at the bottom of the load block so as to facilitate the lifting and lowering activities of the crane.

FIG. 1 shows a conventional prior art application of a load block 2. As can be seen, the load block 2 is affixed to the end of a line 4 extending from the winch 6 of the crane 7. A boom 8 extends outwardly from the platform 9. As shown in FIG. 1, the lifting device is a lifting system on a railroad line. In normal use, the load block 2 will include at least one sheave which allows the line 4 to extend therearound. Quite commonly, the load block 2 will include a plurality of sheaves so as to facilitate the lifting and weight requirements of the winch 6 of the crane 7. Normally, the line will extend around the sheaves in a predetermined manner so as to reduce the lifting forces. One end of the line 4 is shown as affixed to a surface of the boom 8 of the crane 7. This end of the line 4 will remain fixed during the lifting and lowering activities of the load block 2. When it is desired to lift the load block 2, then the winch 6 will rotate so as to pull in the line 4. If it is desired to lower the load block 2, then the winch 6 will reel out the line 4 so that the load block 2 is lowered. The sheaves within the interior of load block 2 continually roll relative to the movement of the line 4.

In normal onshore uses, the load block 2 should last for an indefinite period of time. The load block 2 includes a steel body, contains sheaves rotatably positioned within the body, and has a hook extending outwardly from a bottom of the body. Normally, the hook will have a threaded shank. A nut is positioned around the threaded shank so as to retain the hook in a proper position extending outwardly of the bottom of the body of the load block 2.

Unfortunately, in marine applications, the load block 2 is subjected to a large number of corrosive actions. For example, the load block 2 is constantly affected by sea water. As a result, rules have come into effect that require the periodic inspection of these load blocks. Since the load blocks are utilized in the lifting of large weights, it can often be dangerous if the load block is sufficiently corroded that a failure of the load block occurs. These failures can often occur in the joining of the shank to the body of the load block or in the shaft which is used to support the sheaves of the load block. A great deal of personal injury litigation has resulted, in the past, over the failure of such load blocks in the marine environment.

Although the requirements of the marine environment dictate that a different type of load block 2 be used then that used in conjunction with the railroad car shown in FIG. 1, it is virtually always the case that the offshore operators will utilize similar load blocks. As a result, the load blocks will become quickly corroded during their use in the offshore environment. Corrosion of the load blocks makes inspection difficult or nearly impossible. Often, if inspection is impossible, the load block must be replaced by a properly inspected and approved load block. The replacement of these load blocks can be very expensive to the operator. In certain circumstances, the load block can be so corroded that it will result in catastrophic failure. In other circumstances, the load block will corrode or deteriorate to the point that it no longer functions effectively as a load block.

It is an object of the present invention to provide a load block that is resistive of the elements in the marine environment.

It is another object of the present invention to provide a load block that facilitates the inspection and/or repair of the load block.

It is a further object of the present invention to provide a load block that facilitates the reeving of the load block.

It is a further object of the present invention to provide a load block that offers improved strength, stability, and safety.

These and other objects and advantages of the present invention will become apparent from a reading of the attached specification and appended claims.

SUMMARY OF THE INVENTION

The present invention is a load block that includes a body, a sheave rotatably positioned within the body, and a hook having a shank received within the body. The shank has a portion which is positioned in a generally air-tight volume within the body.

The body of the present invention includes a first side plate, a second side plate in generally parallel relationship to the first side plate, and a crossblock fixed to and extending between the first and second side plates. The air-tight volume is formed at least partially within the crossblock. The portion of the shank is received within the air-tight volume of the crossblock. The shank extends outwardly from a bottom of the crossblock. The crossblock further includes a cover affixed to a top surface of the crossblock in generally liquid-tight relationship to the crossblock. The crossblock also includes a liquid which is used to fill the volume of the crossblock so as to extend around a portion of the shank. The liquid which is used to fill the interior volume can be oil or grease.

The crossblock has an annular opening extending from the volume to the bottom of the crossblock. This annular opening receives the shank of the hook. A thrust bearing is positioned adjacent to the volume for rotatably receiving the shank relative to the crossblock. A bushing is positioned in the annular opening adjacent to the bottom so as to retain the liquid within the crossblock.

The cover has a check valve positioned on a surface of the cover. This check valve allows air to pass from the volume of the crossblock and for preventing air from passing into this volume.

The first side plate has a first slot formed therein. The second side plate has a second slot formed therein in alignment with the first slot. The crossblock has ends which are received within these first and second slots. The body further includes a first keeper plate which is removably affixed to a surface of the first side plate so as to extend over an end of the crossblock. The body also includes a second keeper plate affixed to a surface of the second side plate so as to extend over another end of the crossblock. A valve is formed so as to extend through the crossblock to be in communication with the liquid-receiving volume. The valve serves to allow for the selective introduction of the corrosion-resistant liquid into this volume.

The shank of the hook has a threaded end. A nut is threadedly affixed to the threaded end of the shank. Both the nut and the threaded end of the shank are positioned in the air-tight volume of the crossblock.

The body has a shaft extending therein above the volume. The sheave has bearings positioned along an inner diameter of the sheave. These bearings have an inner race extending therearound. The inner race extends around and adjacent to the shaft. The shaft is removably and non-rotatably secured to the body. In the present invention, a cheek weight is threadedly affixed to an exterior surface of the body. Additionally, the present invention includes a first dead-eye integrally affixed to one side of the body, and a second dead-eye integrally affixed to an opposite side of the body.

DETAILED DESCRIPTION OF THE INVENTION

Figure 1:
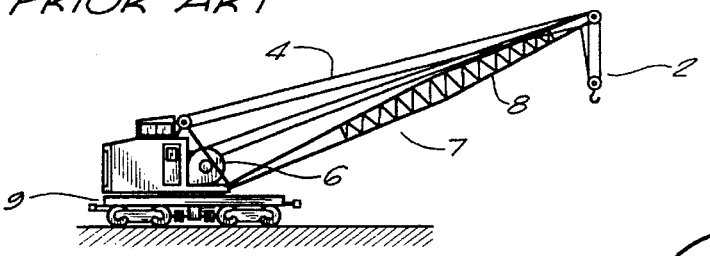
FIG. 1 PRIOR ART
FIG. 1 shows a prior art crane system utilizing a load block.
Figure 2:
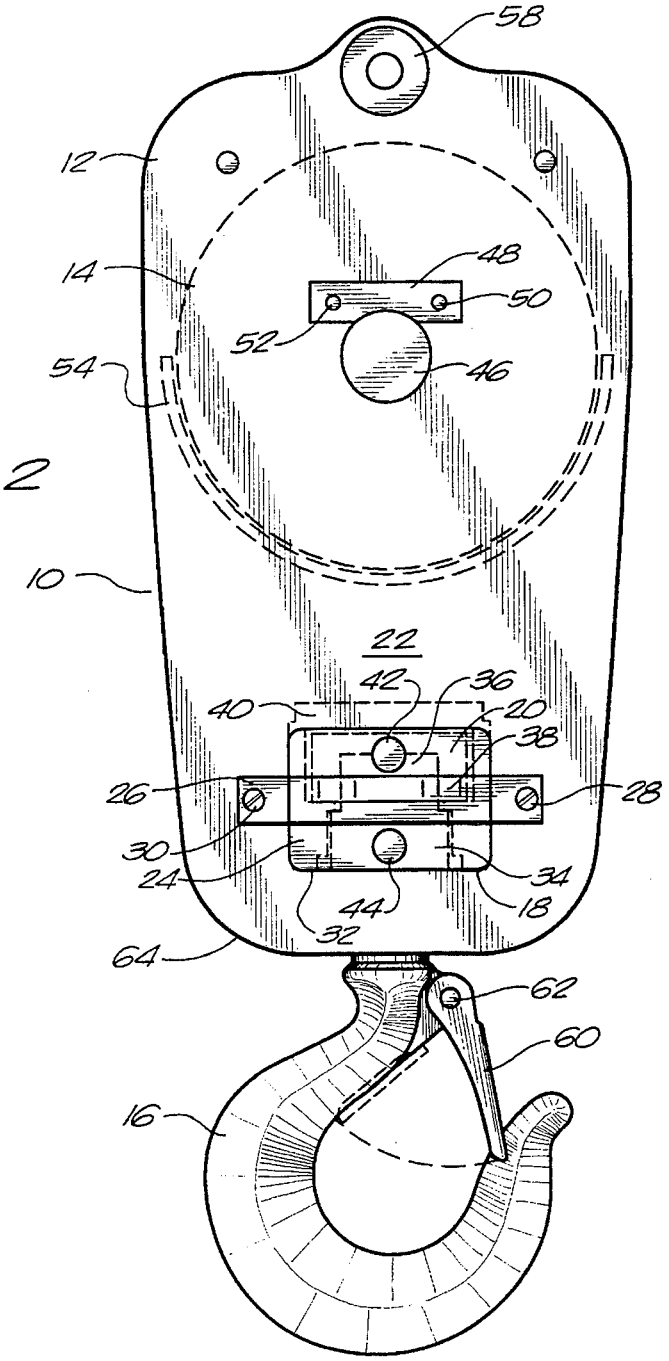
FIG. 2 is a side elevational view, in partial cross-section, of the load block in accordance with the present invention.

Referring to FIG. 2, there is shown at 10 the load block in accordance with the preferred embodiment of the present invention. The load block 10 includes a load block body 12, a sheave 14 rotatably positioned within the body 12, and a hook 16 having a shank 18 received within the body 12. In accordance with the present invention, the shank 18 is positioned in a generally air-tight volume 20 formed in a crossblock 24 within the body 12.

As can be seen in FIG. 2, the body 12 has a generally rectangular configuration. As will be described hereinafter, the body 12 includes a first side plate 22 and a second side plate (not shown in FIG. 2) in generally parallel relationship thereto. A crossblock 24 is affixed to and extends between the first side plate 22 and the second side plate. As can be seen in FIG. 2, the air-tight volume 20 is formed within the crossblock 24.

The body 12 has a first keeper plate 26 threadedly affixed at 28 and 30 to a surface of the side plate 22. The keeper plate 26 is positioned over the end of the crossblock 24. As such, the keeper plate 26 serves to secure the crossblock 24 within slot 32 formed in the side plate 22.

The crossblock 24 has an annular opening 34 that serves to receive the shank 18 of hook 16. As will be described hereinafter, a thrust bearing and a bushing serve to secure the shank 18 within the annular opening 34. The upper end 36 of the shank 18 is positioned within the the air-tight volume 20. A nut 38 serves to secure the threaded end 36 of the shank 18 within the air-tight volume 20. The nut 38 is threadedly affixed to the end 36 of shank 18. A cap 40 is affixed over the air-tight volume 20 at the top surface of the crossblock 24. The cover 40 is affixed in generally liquid-tight relationship to the top surface of the crossblock 24. In normal use, a liquid, such as grease or oil, will fill the air-tight volume 20 so as to prevent oxygen, and other elements, from affecting the shank 18, the nut 38, or the associated bearing and bushing.

Valves 42 and 44 are provided so as to extend into the air-tight volume 20 and into the annular opening 34. The valves 42 and 44 allow for the introduction of the corrosion-resistant liquid into the air-tight volume 20. In conventional use, the valves 42 and 44 will be grease inlet valves (otherwise known as grease zerks).

The sheave 14 is positioned over a shaft 46. Shaft 46 is removably and non-rotatably secured to the body 12. Since the sheave 14 is illustrated in broken line fashion, it can be seen that the sheave 14 is positioned on the interior of the body 12 between the first side plate 22 and the second side plate 24. Within the concept of the present invention, a plurality of sheaves 14 can be arranged along shaft 46. The shaft 46 is secured, at one end, to the side plate 22 through the use of a keeper plate 48. The keeper plate 48 is threadedly secured at 50 and 52 to the body 12. The keeper plate engages a slot formed on the top surface of the shaft 46. A half pipe 54 is positioned between the first side plate 22 and the second side plate of body 12. The half pipe 54 is also positioned in proximity to the outer diameter of the sheave 14. The half pipe 54 facilitates the ability to reeve the sheave 14. In other words, the half pipe 54 serves as a guide and a keeper for the line going through the sheave 14. As a keeper, the half pipe 54 prevents the wire rope line from jumping off the sheave in the event of a sudden let off or release of the load. The half pipe 54 has drain holes in the bottom to drain water, and other liquids, so as to prevent corrosion in the sheave area.

A dead-eye 58 is integrally affixed to the top of the first side plate 22 of body 12. The dead-eye 58 serves to receive an end of the line passing around the sheave 14. Another dead-eye is formed on the second side plate of the body 12 generally aligned with the dead-eye 58.

The hook 16 is a generally conventional load block hook. A retaining arm 60 is rotatably fastened at pivot 62 to the hook 16. The arm 60 can move backward and forward so as to secure a line, or other object, within the hook 16. It can be seen that the hook 16 extends downwardly from the bottom 64 of the body 12.

Figure 3:
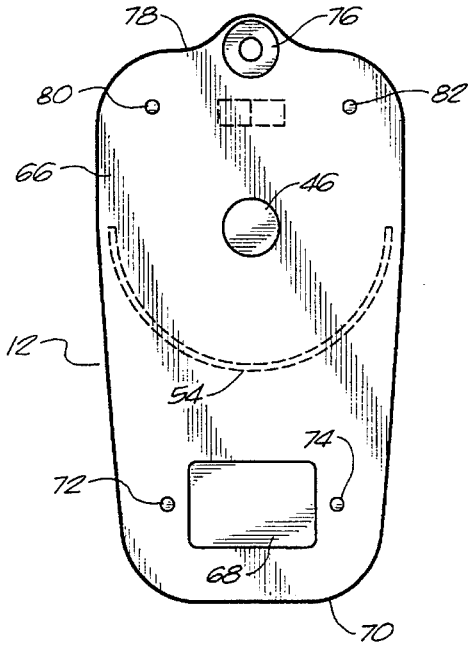
FIG. 3 is a side elevational view of the body of the load block of the present invention.

FIG. 3 is an isolated side view of the body 12 of load block 10. Specifically, the body 12 shows the second side plate 66 in its isolated condition. The second side plate 66 has a configuration similar to the first side plate 22. The second side plate 66 is in generally parallel relationship to the first side plate 22. It can be seen that a second slot 68 is formed adjacent to the bottom 70 of the second side plate 66.

The second slot 68 serves to receive an opposite end of the load block 24. Holes 72 and 74 are provided adjacent to the slot 68 so as to allow for the threaded receipt of an appropriate keeper plate extending over the end of the crossblock 24.

The second side plate 66 also includes a second dead-eye 76 integrally affixed adjacent to a top surface 78. The second dead-eye 76 facilitates the ability to properly affix the end of the line to the load block. It is important to note that, in the present invention, a dead-eye 58 is provided with the first side plate 22 and a second dead-eye 76 is provided with the second side plate 66. The positioning of the dead-eyes 58 and 76 on opposite sides of the body 12 facilitates the ability to reeve the sheave 14. In normal applications, it is often difficult to properly reeve the load block. Often, the load line passes through the multiple sheaves on the shaft 46 only to find that a dead-eye is on the opposite side of the body 12. As such, a pair of dead-eyes 58 and 76 have been provided in the present invention so as to avoid confusion and to assure that a proper reeving of the load block 12 can occur.

A pair of holes 80 and 82 are provided on the second side plate 66 of body 12 generally adjacent the top surface 78. Holes 80 and 82, in combination with holes 72 and 74 are provided for the purpose of attaching a cheek weight (to be described hereinafter). When a cheek weight is applied to the holes 72, 74, 80 and 82, it is not necessary to apply the keeper plate across the slot 68.

Figure 4:
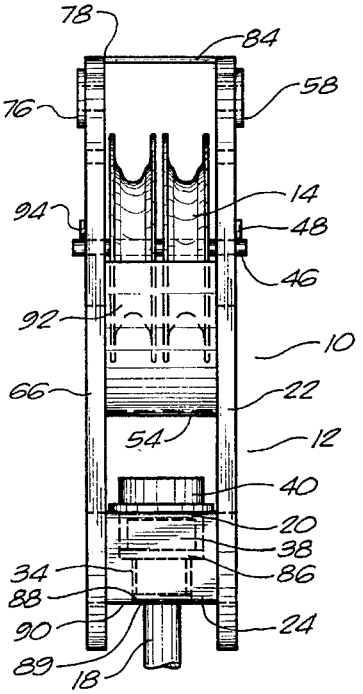
FIG. 4 is a front elevational view of the load block of the present invention.

FIG. 4 shows the arrangement on the interior of the body 12 of the load block 10. In FIG. 4, it can be seen that the body 12 includes the first side plate 22 and the second side plate 66. The crossblock 24 extends between the side plates 22 and 66 and is secured therebetween. The half pipe 54 is shown positioned generally centrally between the side plates 22 and 66. The combination of the brace 84, the half pipe 54, and the crossblock 24 provides for the structural integrally of the load block 10.

The crossblock 24 is shown as having the air-tight volume 20 formed therein. The cover 40 is affixed to the top of the crossblock 24 so as to provide a liquid-tight seal over the air-tight volume 20. The shank 18 of the hook 16 extends upwardly into the air-tight volume 20. A nut 38 is threadedly affixed to the end of the shank 18 in the air-tight volume 20. The nut 38 is supported on a thrust bearing 86 at the bottom of the air-tight volume 20. A radial alignment bushing 88 is provided between the bottom 90 and the air-tight volume 20. A seal 89 is pressed in under the bushing to retain the corrosion-resistant liquid and to create the air-tight seal. The seal 89 is positioned adjacent the bottom 90 in the annular opening 34. The seal 89 serves to retain the corrosion-resistant liquid on the interior of the crossblock 24. The abutment of the nut 38 with the thrust bearing 86 allows the shank 18, and the associated hook 16, to rotate relative to the load block 10.

Importantly, in FIG. 4, it can be seen that the provision of the air-tight volume 20 assures a corrosion-resistant area for the joining of the nut 38 and the end of the shank 18. In normal use, the air-tight volume 20 will be filled with a corrosion-resistant liquid so that the air is removed from this volume 20. When the corrosion-resistant liquid is injected into the air-tight volume 20, the air will pass outwardly through a check valve formed on the cover 40 (to be described hereinafter). As a result, the interior volume 20 will be completely filled with the corrosion-resistant liquid. The cover 40 is threadedly secured to the top surface of the crossblock 24. When it is necessary to access the nut 38 and/or the top of the shank 18, it is only necessary to remove the cover 40 and to threadedly remove the nut 38 from the end of shank 18. As a result, inspection of the connection of the shank 18 to the crossblock 24 is more easily conducted. Additionally, the present invention facilitates the ability to repair the load block 10, if necessary. The liquid-tight connection between the cover 40 and the crossblock 24 assures that the corrosive sea water, or other elements, will not enter this area of connection.

In FIG. 4, it can be seen that the sheave 14 is supported on shaft 46 in the area between the first side plate 22 and the second side plate 66. Additionally, a second sheave 92 is also supported on shaft 46 adjacent to the first sheave 14. It is important to note that the shaft 46, along with the load block 10, can be configured to accommodate various numbers and arrangements of sheaves 14 and 92. The shaft 46 is secured at one end by the keeper plate 48. The shaft 46 is secured at the other end by a keeper plate 94. Each of the keeper plates 48 and 94 are threadedly secured to the outer surfaces of the first side plate 22 and the second side plate 66, respectively. The sheaves 14 and 92 are rotatably positioned over the fixed shaft 46. The dead-eyes 58 and 76 are illustrated as positioned on the side plates 22 and 66, respectively.

Figure 5:
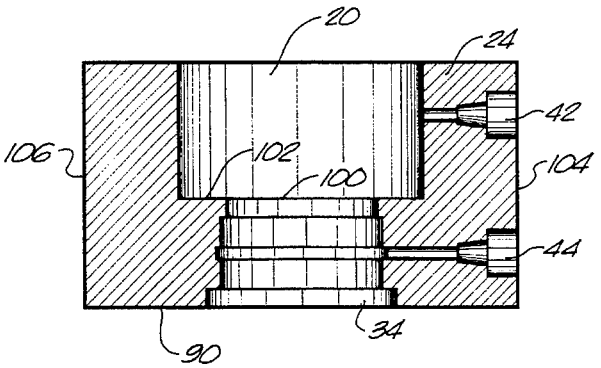
FIG. 5 is a cross-sectional view of the crossblock of the load block of the present invention.

FIG. 5 illustrates an isolated view of the crossblock 24 as used on the load block 10 of the present invention. It can be seen that the crossblock 24 has the air-tight volume 20 formed therein. The annular opening 34 extends downwardly from the volume 20. Valves 42 and 44 are provided so as to be communication with the air-tight volume 20 and with the annular opening 34, respectively. The air-tight volume 20 is generally a cylindrical chamber formed on the interior of the crossblock 24. The thrust bearing 86 is received adjacent to the opening 100 at the bottom of the air-tight volume 20. Similarly, the bushing 88 is received in the annular opening 34 adjacent to the bottom 90 of the crossblock 24. The valve 42 is suitable for injecting the corrosion-resistant liquid directly into the chamber 20. The valve 44 is suitable for injecting the corrosion-resistant liquid into the area between the bottom 100 of chamber 20 and the annular opening 34 at the bottom 90 of crossblock 24. The shank 18 of the hook 16 extends into the annular opening 34 through the opening 100 and into the chamber 20. The nut 38 will be in abutment with a thrust bearing positioned on the surface 102 at the bottom 100 of chamber 20. The end 104 of the crossblock 24 will extend into the slot 32 formed on the side plate 22. The end 106 will extend outwardly of the slot 68 formed on the second side plate 66.

Figure 6:
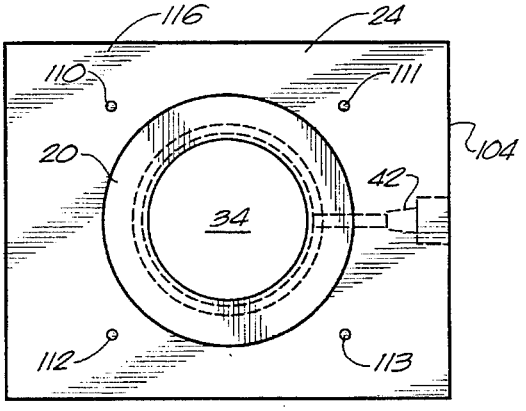
FIG. 6 is a top view of the crossblock of the load block of the present invention.

FIG. 6 is a top view of the crossblock 24. In FIG. 6, it can be seen that the air-tight volume 20 has a generally cylindrical configuration. The annular opening 34 is formed at the bottom of the crossblock 24. Valve 42 is shown as extending from the end 104 so as to be in communication with the interior volume 20. The crossblock 24 is shown as having a generally rectangular configuration. A plurality of holes 110, 111, 112, and 113 are formed on the top surface 116 of the crossblock 24. The holes 110, 111, 112, and 113 serve to receive the cover 40 in liquid-tight engagement with the top surface 16 of crossblock 24.

Figure 7:
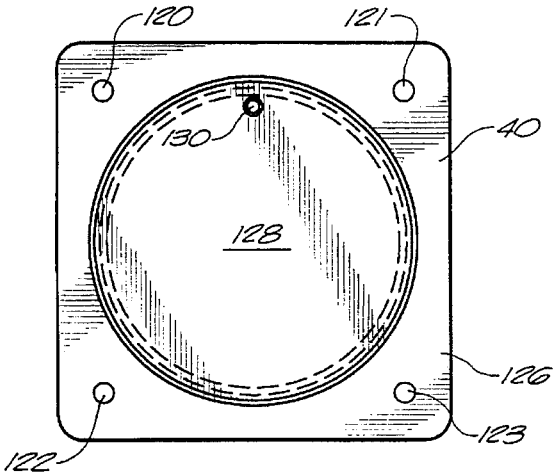
FIG. 7 is a top view of the cover for the crossblock of the present invention.

FIG. 7 is a top view of the cover 40 which is used to seal the air-tight volume 20. The cover 40 has openings 120, 121, 122, and 123 formed in a rectangular configuration on the flange surface 126. The openings 120, 121, 122, and 123 will match with the holes 110, 111, 112, and 113 on the top surface 116 of the crossblock 24. As such, the cover 40 can be threadedly secured to the top surface 116 of the crossblock 24. The cover 40 includes an upwardly extending top surface 128. The top surface 128 includes a check valve 130. Check valve 130 is configured so as to allow air to pass from the interior of the cover 40 outwardly but to prevent air from passing from the exterior of the cover 40 into the air-tight volume 20 of crossblock 24. In normal use, as the air-tight volume 20 is being filled with a corrosion-resistant liquid, the air is displaced and forced out of the check valve 130. As such, it is possible to create a corrosion-resistant liquid-filled area around the end of the shank 18.

Figure 8:
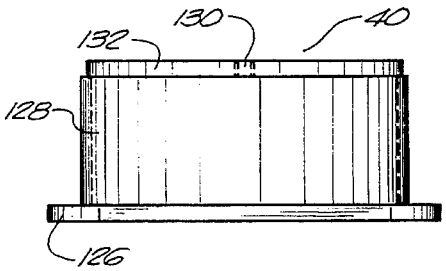
FIG. 8 is a side elevational view of the cover for the crossblock of the present invention.

FIG. 8 shows a side view of the cover 40. It can be seen that the flange 126 extends outwardly from the upward extending top surface 128. Check valve 130 is formed on the top surface 132 of the upwardly extending cover portion 128. The upward extending cover portion 128 serves to allow for extra room in which to receive the upper end of the shank 18 (should it extend beyond the top surface 116 of crossblock 24).

Figure 9:
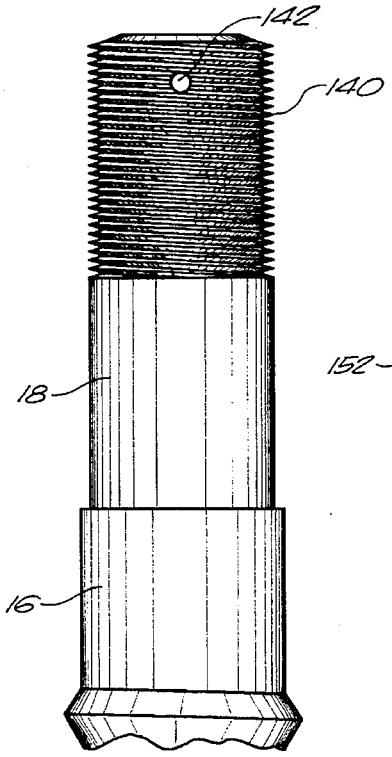
FIG. 9 is a side view of the shank of the load block of the present invention.

FIG. 9 is an isolated view of the shank 18 of hook 16. It can be seen that the shank 18 has a threaded end 140. In normal use, the nut 38 will be threadedly received on the threaded end 140 of shank 18. Hole 142 extends through the threaded end 140 of shank 18 so as to receive a pin therein. After the nut is threaded over the threaded end 140, a pressed pin can be inserted into the hole 142 so as to prevent the removal or loosening of the nut.

Figure 10:
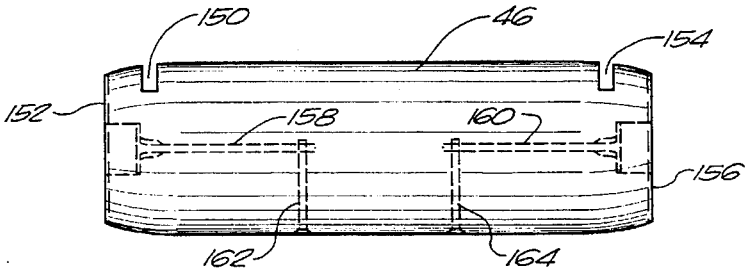
FIG. 10 is an isolated view of the shaft used for supporting the sheave of the load block of the present invention.

FIG. 10 is an isolated view of the shaft 46 used for securing the sheaves 14 on the interior of the load block 10. The shaft 46 has a cylindrical configuration. Notch 150 is formed adjacent to the end 152 of shaft 46. Similarly, notch 154 is formed adjacent to the end 156 of the shaft 46. The notches 150 and 154 serve to keep the shaft 46 secured in a fixed position (both axially and rotationally) relative to the side plates 22 and 66 of load block 10. The notches 150 and 154 receive the keepers 48 and 94. When the keepers 48 and 94 are removed, the shaft 46 can be slidably removed from the load block 10 for inspection and/or repair. Interior passageways 158, 160, 162, and 164 are provided so as to allow for the introduction of a lubricating fluid to the outer surface of the shaft 46 adjacent to the sheaves.

Figure 11:
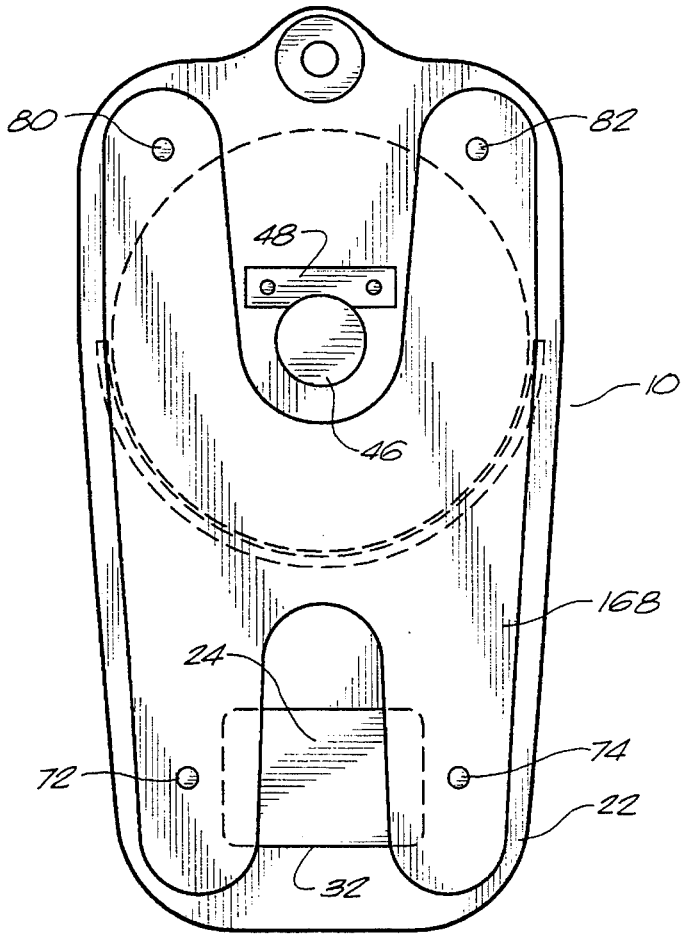
FIG. 11 shows a cheek plate as affixed to a surface of the body of the load block of the present invention.

FIG. 11 shows the load block 10 having a cheek weight 168 affixed to the surface of the first side plate 22. The cheek weight 168 is commonly added to add bulk or weight to the load block 10. In many circumstances, a load block must have sufficient weight so as to allow for proper use of the wire line. The present invention facilitates the ability to use the cheek weight by providing holes 72, 74, 80, and 82 on the outer surface of the first side plate 22. The cheek weight 168 also includes corresponding holes formed therethrough. As a result, the cheek weight 168 can be threadedly secured to the surface of the side plate 22. The configuration of the cheek weight 168 is in the form of a "H". The bottom portion of this H-shaped configuration acts as a keeper plate for securing the crossblock 24 in its proper position within the slot 32. When the cheek weight 168 is used, then there is no need to use the keeper plate 26. The upper portion of the H-shaped configuration accommodates the keeper plate 48 and the outwardly extending shaft 46. The second side plate 66 can also include similar openings for securing another cheek weight. The size, strength, and quality of the cheek weight 168 will depend upon the application to which the load block 10 is used.

Figure 12:
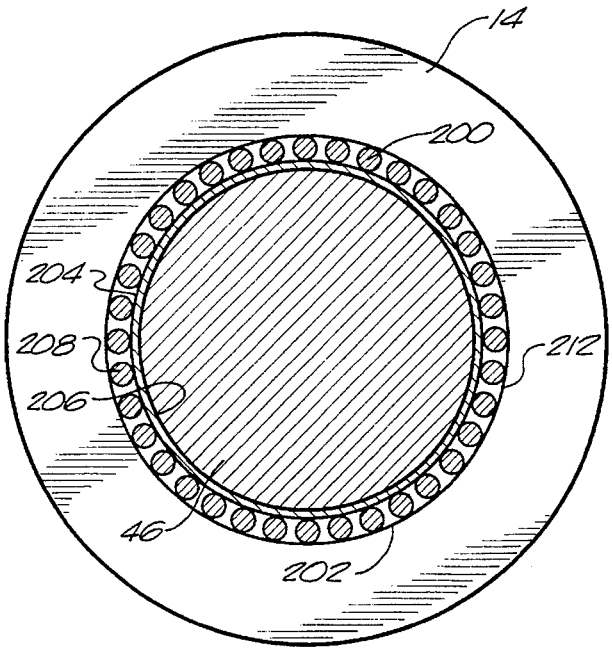
FIG. 12 is a cross-sectional view showing the sheave as positioned over the shaft within the load block.

FIG. 12 shows an additional benefit of the load block 10 of the present invention. In FIG. 12, the sheave 14 is illustrated as extending around the shaft 46. Importantly, a bearing assembly 200 extends around the inner diameter 202 of the sheave 14. In the present invention, an inner race 204 is positioned adjacent to the outer diameter 206 of the shaft 46. Specifically, the bearing assembly 200 includes the inner race 204. As such, the roller bearings 208 extending around the bearing assembly 200 will roll against the inner race 204, rather than directly against the outer surface 206 of shaft 46.

In normal bearing manufacturing processes, the inner race is matched in strength and quality to the outer race 212 and to the roller bearings 208. As such, the life of the bearing assembly 200 is improved. However, in conventional sheave installations in load blocks, there has been no use of the inner race 204. As such, the rollers 208 directly contact the outer surface 206 of shaft 46. In the marine environment, the interaction of the rollers 208 and the shaft 46 causes a quick and serious deterioration of the shaft 46. This interaction facilitates the distribution of the corrosion-causing elements and also provides the necessary bearing/shaft interaction to quickly destroy the shaft 46. The provision of the inner race 204 eliminates this problem since the rollers 208 directly roll against the inner race 204, rather than against the outer surface 206 of shaft 46.

The present invention offers a number of advantages over prior load blocks. The configuration of the present invention provides a true 5:1 safety factor which adheres to A.P.I. 2C and A.I.S.C. design criteria. In the present invention, the load sheaves 14 and 92 utilize "inner" races on anti-friction bearing assemblies for ease of inspection and repair. In the present invention, the hook shank, the thrust bearing, the shank nut, and the radial shank bushing are sealed under a pressure-relieved trunion cap and sealed trunion. The disassembly of the load block 10 of the present invention, for inspection or repair, can be accomplished from either side of the load block. All that is required is the removal of the keeper plate 26 which serves to retain the crossblock 24 in position. Additionally, the shaft 46 can be removed by simply removing either of the keeper plates 48 or 94 from the side plates 22 or 66. The present invention provides a dead-eye for odd number parts of line on both sides of the block. This dead-eye is an integral part of the block, it is not "added on" or "welded on". The uni-body construction of the load block 10 adds strength, stability and safety to the operational aspects of load block 10. In the present invention, cheek weights 168 can be added without disassembling the load block 10. In the present invention, the trunion, the trunion cap, the cheek weights, and the body are hot dipped galvanized with two coat marine duty paint systems added. In the present invention, the body, cheek weights, the crossblock, the keepers, and the crossblock cover can be made of stainless steel instead of conventional carbon steel and galvanizing. The sheaves may be made of steel, stainless steel or a polymer-type plastic. In the present invention, the trunion and hook assembly can be removed while the system remains reeved to the crane for inspection or repair. The shaft 46 and the crossblock 24 are individually ported to each sheave and to the trunion bearing assembly.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A load block comprising:

a body comprising:

a first side plate;

a second side plate in generally parallel relationship to said first side plate;

a crossblock affixed to and extending between said first and second side plates, said first side plate having a first slot formed therein, said second side plate having a second slot formed therein in alignment with said first slot, said crossblock having ends received within said first and second slots:

a first keeper plate removably affixed to a surface of said first side plate so as to extend over an end of said crossblock; and a second keeper plate affixed to a surface of said second side plate so as to extend over another end of said crossblock;

a sheave rotatably positioned within said body; and a hook having a shank received within said body, said shank having a portion positioned in a generally air-tight volume within said body.

2. The load block of claim 1, said air-tight volume formed at least partially within said crossblock.

3. The load block of claim 2, said portion of said shank received within said air-tight volume of said crossblock, said shank extending outwardly from a bottom of said crossblock, said crossblock further comprising:

a cover affixed to a top of said crossblock, said cover in generally liquid-tight relationship to said crossblock; and a liquid filling said volume of said crossblock so as to extend around said portion of said shank.

4. The load block of claim 3, said crossblock having an annular opening extending from said volume to said bottom of said crossblock, said annular opening receiving said shank of said hook, said crossblock further comprising:

a thrust bearing means positioned adjacent said volume, said thrust bearing means for rotatably receiving said shank relative to said crossblock; and a bushing means positioned in said annular opening adjacent said bottom, said bushing means for retaining said liquid within said crossblock.

5. The load block of claim 3, said cover having a check valve means positioned on a surface thereof, said check valve means for allowing air to pass from said volume and for preventing air from passing into said volume.

6. The load block of claim 3, said crossblock further comprising:

a valve means formed so as to be in communication with said volume, said valve means for selectively introducing said liquid into said volume.

7. The load block of claim 1, said shank of said hook having a threaded end, said threaded end having a nut threadedly affixed thereto, said nut and said threaded end being in said air-tight volume.

8. The load block of claim 1, said body having a shaft extending therein above said volume, said sheave having a bearing assembly positioned at an inner diameter of said sheave, said bearing assembly having an inner race extending therearound, said inner race extending around and adjacent to said shaft.

9. The load block of claim 8, said shaft being removably and non-rotatably secured to said body.

10. The load block of claim 1, further comprising:

a cheek weight threadedly affixed to an exterior surface of said body.

11. The load block of claim 1, further comprising:

a first dead-eye integrally affixed to one side of said body; and a second dead-eye integrally affixed to an opposite side of said body.

12. A load block comprising:

a body having a first side plate and a second side plate;

a plurality of sheaves rotatably positioned in said body;

a hook affixed to and extending downwardly from said body;

a first load-bearable dead-eye integrally formed in said first side plate; and a second load-bearable dead-eye integrally

13. The load block of claim 12, each of said sheaves being rotatably positioned on a shaft within said body, each of said sheaves each having a bearing assembly extending around an inner diameter of said sheaves, said bearing assembly having an inner race extending therearound and adjacent to said shaft, said hook having a shank received within said body, said shank having a portion positioned in a generally air-tight volume within said body.

* * * * *